US005779953A

United States Patent [19]

Harala et al.

[11] Patent Number: 5,779,953

[45] Date of Patent: Jul. 14, 1998

[54] METHOD AND A DEVICE FOR MAKING CONCRETE PRODUCTS

[75] Inventors: Olli Harala, Petsamontie; Risto Sutinen, Toijala; Lassi Järvinen, Koulukatu, all of Finland

[73] Assignee: Partek Concrete Engineering Oy, Toijala, Finland

[21] Appl. No.: 732,470

[22] PCT Filed: Apr. 26, 1995

[86] PCT No.: PCT/FI95/00228

§ 371 Date: Oct. 29, 1996

§ 102(e) Date: Oct. 29, 1996

[87] PCT Pub. No.: WO95/29799

PCT Pub. Date: Nov. 9, 1995

[30] Foreign Application Priority Data

Apr. 29, 1994 [FI] Finland ..... 941992

[51] Int. Cl.[6] ..... B28B 1/08; B28B 13/02

[52] U.S. Cl. ..... 264/70; 264/69; 425/219; 425/427; 425/432

[58] Field of Search ..... 264/69, 70; 425/219, 425/427, 432

[56] References Cited

U.S. PATENT DOCUMENTS

| | | | |
|---|---|---|---|
| 3,423,492 | 1/1969 | Jonell et al. | 264/70 |

FOREIGN PATENT DOCUMENTS

| | | | |
|---|---|---|---|
| 965687 | 6/1957 | Germany . | |
| 1252569 | 10/1967 | Germany . | |
| 3502861 | 7/1986 | Germany . | |
| 296654 | 5/1971 | U.S.S.R. . | |
| 336160 | 7/1972 | U.S.S.R. . | |
| 507447 | 4/1976 | U.S.S.R. | 425/432 |
| 613896 | 5/1978 | U.S.S.R. . | |
| 688340 | 9/1979 | U.S.S.R. . | |
| 979124 | 12/1982 | U.S.S.R. | 425/219 |
| 1097501 | 6/1984 | U.S.S.R. . | |

OTHER PUBLICATIONS

Derwent Publication BO666X/05 Jul. 1975.

Derwent Publication D3306D/15 Jul. 1980.

International Search Report (PCT/ISA/210) dated 17 Jul. 1995.

*Primary Examiner*—James Derrington

*Attorney, Agent, or Firm*—Burns, Doane, Swecker & Mathis, L.L.P.

[57] ABSTRACT

A method and a slide casting apparatus for casting concrete products. Concrete is fed into a mold through a feeding hopper (9) fitted above the mould. The feeding hopper (9) is moved so that the vertical component of the path of motion of the hopper's bottom part is equal to or exceeds the vertical component of the path of motion of the top part, which >0 or =0.

24 Claims, 3 Drawing Sheets

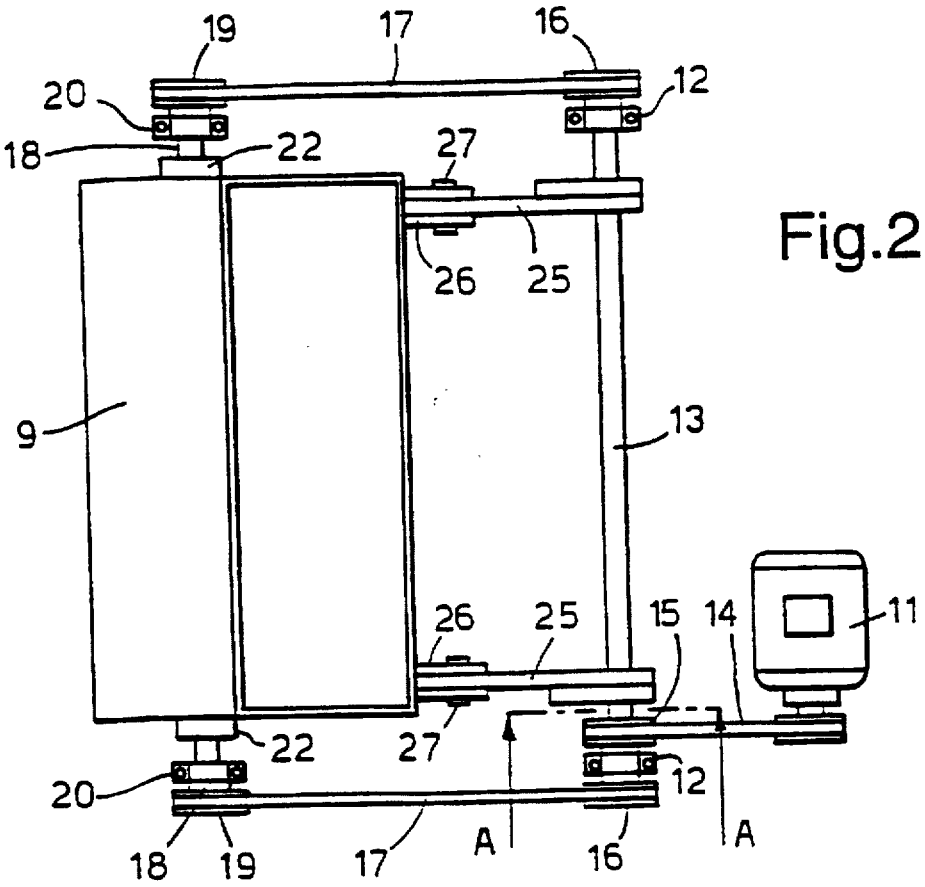
Fig.2
Fig.3.
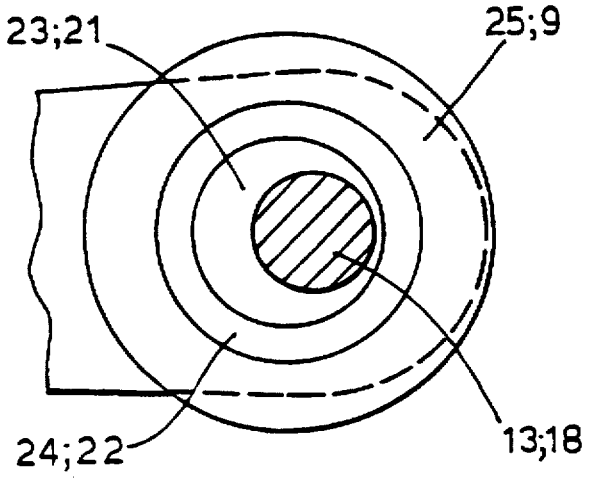

METHOD AND A DEVICE FOR MAKING CONCRETE PRODUCTS

This invention relates to a method of casting concrete products with a slide casting apparatus moving along a base so that concrete mix is fed into a mould through a feeding hopper fitted above the mould and tapering downward towards the discharge opening and being moved along a path of motion deviating from the path of travel of the apparatus. The invention also relates to a slide casting apparatus for casting concrete products and comprising a mould moving in relation to a base and formed by side walls and a top plate and a feeding hopper fitted above the mould and tapering downward towards the discharge opening for feeding concrete mix into the mould, whereby the feeding hopper is provided with means for moving the hopper along a path of motion deviating from the path of travel of the apparatus.

It is previously known to cast concrete products by slide casting. In previously known slide casting machines of the extruder type compacting takes place by using feeding screws which grow thicker towards the rear end and possibly by using vibration. However, a feeding screw mechanism of this kind is relatively complicated and expensive.

It is also known to use slide casting machines of the so-called slipformer type which have no compacting feeding screws. However, in these it is necessary to use concrete mix of plastic consistency and of a relatively high water/cement ratio. A problem with this kind of plastic concrete is its poor dimensional stability immediately after casting and the known fact that the strength of the product made of plastic concrete is poorer. To improve the strength, more cement than in relatively dry concrete must be used in concrete with a high water content. A product cast of plastic concrete also tends to move along with the casting machine, and the resulting friction is abrasive on the casting base.

Such apparatus are also known wherein two feeding hoppers are located one above the other and the lower one is vibrated to compact the concrete. Such devices are described, for example, in SU Patent Publications 455 010 and 751 629.

However, a problem with such vibration of the hopper is that due to the compacting resulting from the vibration, the casting mix tends to be compacted already in the top part of the hopper, where it will arch. This prevents the concrete from flowing into the bottom end of the hopper.

The method in accordance with this invention is characterized in that the feeding hopper is moved along a controlled path of motion so that the vertical component of the path of motion of the hopper's bottom part exceeds or is equal to the vertical component of the path motion of the feeding hopper's top part, which >0 or =0. The device in accordance with the invention is characterized in that the path of motion of the feeding hopper is controlled and the vertical component of the path of motion of its bottom part exceeds or is equal to the vertical component of the path of motion of the feeding hopper's top part which >0 or =0.

In the method according to the invention it is possible to use casting mixes of a clearly stiffer consistency than in slide casting machines of the slipformer type. A lower water/cement ratio has a favourable effect on the strength and dimensional accuracy of the final product. Until now, this advantage has in fact belonged to slide casting methods of the extruder type using screws in order to create pressure and compacting. With the present invention the qualitative advantages of concrete mix of a stiffer consistency are achieved in the final product without any complicated and expensive screw machinery. With the path of motion of the movable hopper arranged in accordance with the invention, the bottom end of the hopper will also act as a part of the mould and will also compact the concrete.

BRIEF DESCRIPTION OF THE DRAWINGS

The invention and its details are described more closely in the following referring to the enclosed drawings, in which FIG. 2 is a top view of the lower hopper of the same apparatus and of its driving mechanism, FIG. 3 is a side view on a larger scale along two similar sections A—A of FIG. 2.

Figure 1:
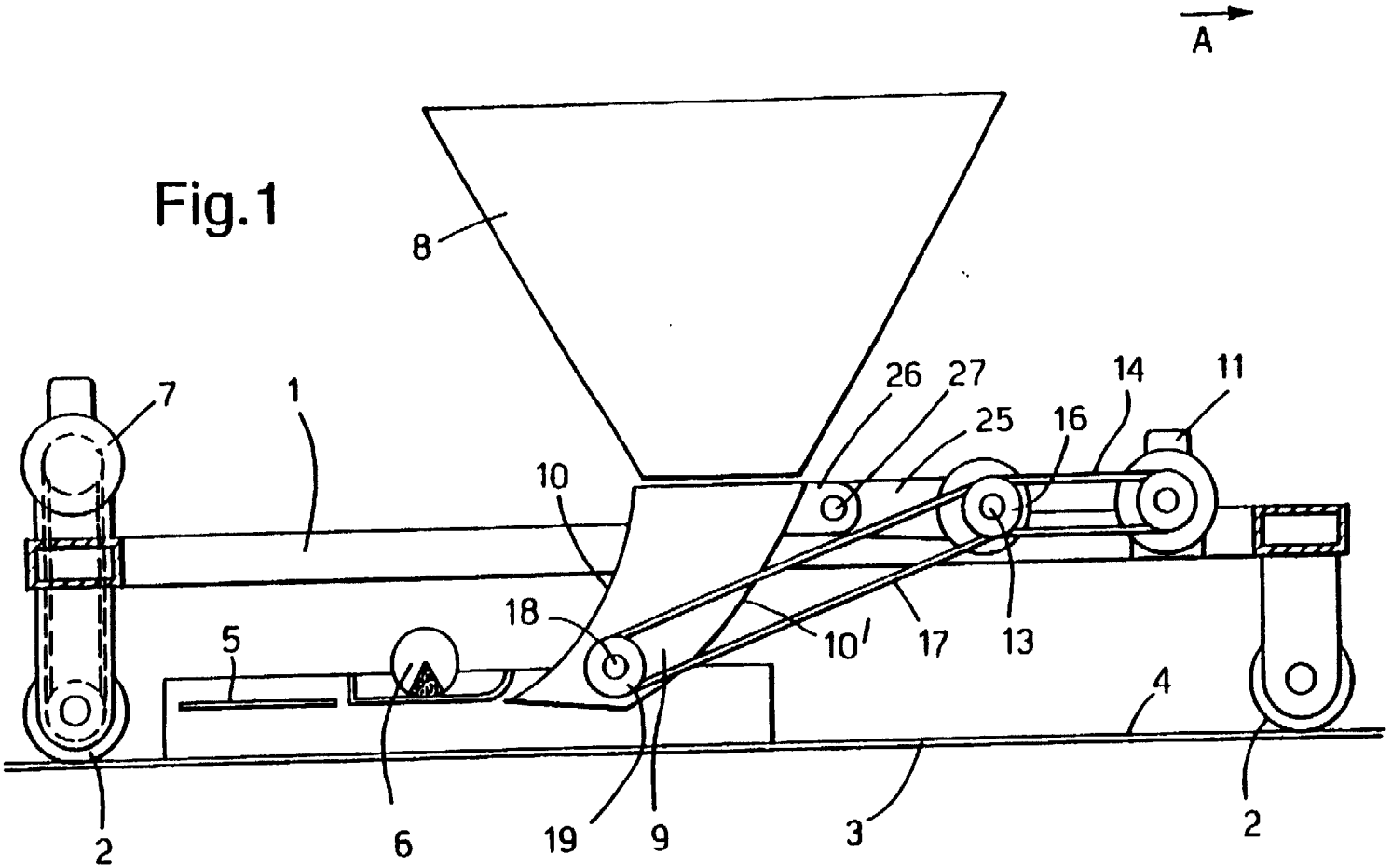
FIG. 1 is a schematic side view of an apparatus according to the invention.

The apparatus according to the invention has a frame 1, which moves on wheels 2 along rails 4 on a base 3. The frame supports a casting mould formed by side walls and a top plate 5. The top plate is provided with a vibrator 6. The driving wheels are driven by a driving mechanism 7 and the device moves in the direction shown by arrow A.

In addition, the frame supports an upper and a lower feeding hopper 8 and 9, one on top of the other and separate from each other.

Both hoppers taper towards their bottom end. In addition, a wall 10 at the trailing end of the lower hopper is tilted so that the bottom end of its inner surface slopes downward towards the trailing end of the machine. Thus, in a way, the bottom end of the hopper forms an extension to the mould's top plate 5. The wall 10' on the front side is also tilted in a corresponding way.

The cross-section of the lower hopper decreases in the concrete compacting zone from the top downward by 0 . . . 80 per cent. The suitable reduction in the cross-section depends on the quality of the concrete and on the need for compacting.

The lower hopper is provided with its own driving mechanism bringing the hopper into an oscillating motion. A motor 11 through a belt 14 and a belt pulley 15 rotates a shaft 13, which is journalled in brackets 12 mounted to the frame. The shaft ends carry belt pulleys 16 from which the motion is transferred by way of belts 17 through belt pulleys 19 to shafts 18 journalled on the sides of the lower hopper. Shafts 18 are supported by bearings 20 in the frame. Eccentric cams 21 are located between shafts 18 and bearings 22 on the hopper 30 sides.

The shaft 13 is connected by eccentric cams 23 and bearings 24 to levers 25, each of which is attached through a link 27 to lugs 26 located at the top end of the lower hopper, on two sides of the hopper.

When the lower hopper is moved by the motor 11, the shaft 18 mounted eccentrically to the bottom part of the hopper 9 makes the bottom end of the hopper move under mechanical control along a forced circular path of motion in a vertical plane in the device's direction of motion.

The motion is transferred to the top end of the lower hopper by levers 25 journalled eccentrically to shaft 13. The directions of rotation of the shafts 13 and 18 are counterclockwise in the drawings. The cams 23 and 21 on the shafts 13 and 18 are arranged so that their phase difference is preferably about 90° as the lower cam 21 moves ahead of the upper cam 23. Hereby the vertical components of motions transferred to the top part of the hopper from the lower cam 21 and from the upper cam 23 by way of link 27 cancel one another, while the horizontal components strengthen one another. This has the result that the path of motion of the top end is a back-and-forth longitudinal motion almost in a horizontal plane.

In addition to the motion of the lower hopper described in the foregoing, the slide casting machine is moved in a conventional manner on the base driven by the driving mechanism 7.

As the back and forth motion of the top end of the lower hopper takes place mainly in a horizontal plane, the concrete will not yet be compacted in the top end of the hopper. To the contrary, the horizontal vibration promotes flowing of the concrete through the top end of the hopper. But in the bottom end of the hopper the motion also has a vertical component which causes efficient compacting of the concrete. In this way the feeding hopper forms a pressurization zone promoting a good flowing of the concrete but preventing arching in the top end of the hopper.

The path of motion described above in combination with a decreasing cross-section causes compacting of the concrete close to its final density. Density and surface quality may be further improved by vibrating the top plate.

Figure 4:
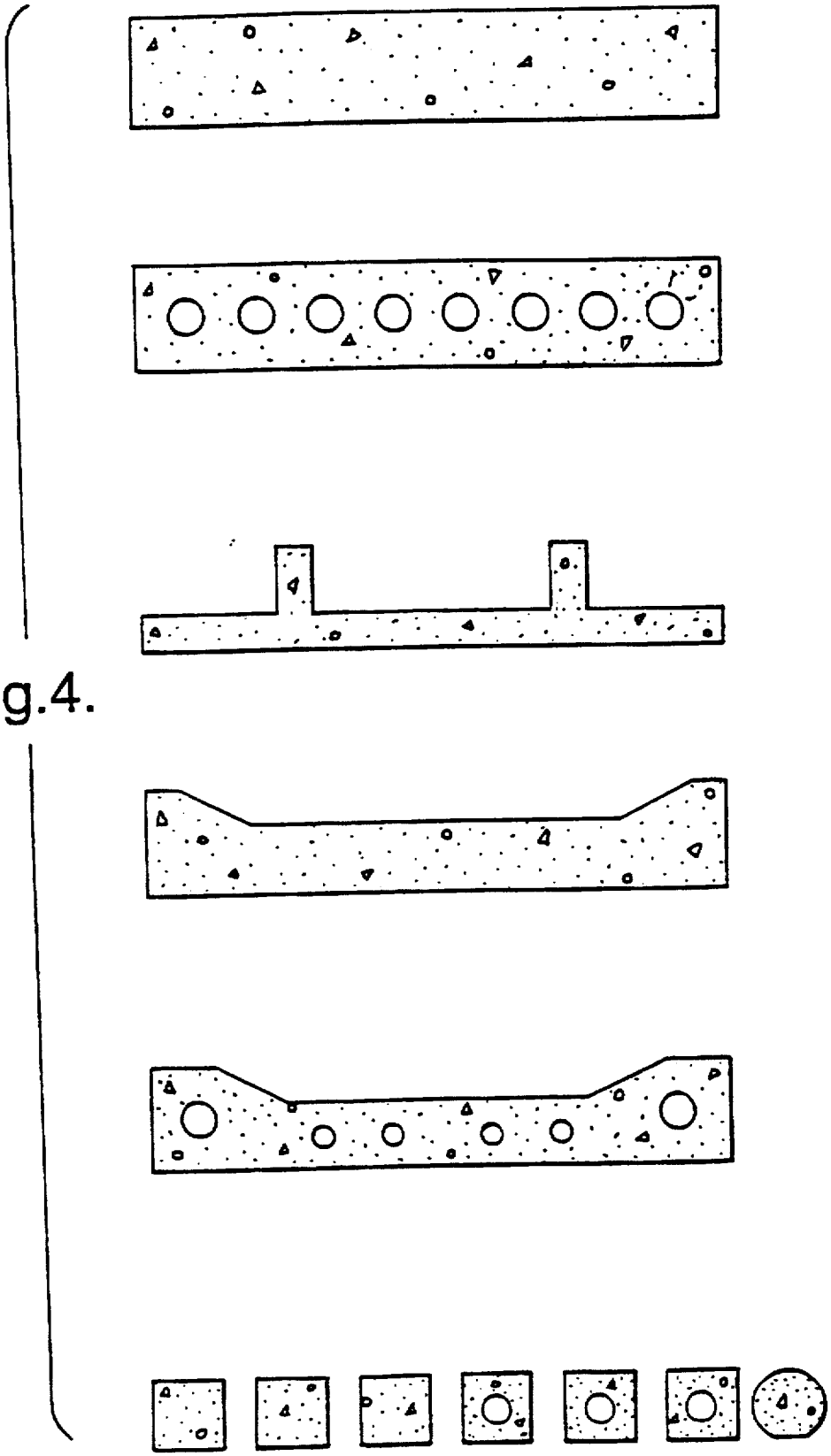
FIG. 4 is a cross-sectional view of different concrete products which can be made with the apparatus according to the invention.

The cross-sectional shape of a product made by the method according to the invention may vary very much. It may be either solid or it may contain hollows which are made by shaping mandrels in the device which are known as such. A rectangular solid or hollowed basic shape may also contain protrusions or recesses. FIG. 4 shows different cross-sectional product shapes by way of example.

It is also possible to cast several different products in parallel at the same time.

The reinforcement of a reinforced concrete product to be made by slide casting may be prestressed or non-prestressed, so-called static reinforcement.

The path of motion according to the invention can be achieved also in ways other than with the described cam-articulated arm structure. The vertical component of the motion of the top end can be limited, for example, by means of a suitable slide arrangement or other stops or guides. A mechanically controlled forced motion can also be achieved by controlled vibration. Such a controlled vibration is different, for example, from the vibration of a flexibly supported hopper in that the hopper's path of motion is not a random path, but will follow a certain predetermined path.

Neither is the upper hopper a necessary part of the invention, it may be replaced with some other feeding arrangement to keep the oscillating hopper constantly and adequately filled so that the concrete may be compacted already in the hopper. For example, a conveyor belt or a feeding screw may be used which moves the concrete from a storage container of the device into the oscillating hopper.

In the solution described above, the horizontal component of the hopper's path of motion is longitudinal. The horizontal component may also be arranged to be crosswise to the machine's direction of travel.

The compacting effect can be further enhanced by forming the wall at the trailing end of the lower hopper separate from the rest of the hopper and by moving it separately. Its path of motion may be, for example, opposite to the motion of the rest of the hopper in the horizontal plane, whereby the compacting effect will enhance compacting of the concrete.

We claim:

1. A method of casting concrete products with a slide casting apparatus, comprising the steps of:

moving the slide casting apparatus, the slide casting apparatus including a feeding hopper having a discharge opening and a mold disposed below the feeding hopper. in a path of travel along a base;

feeding concrete mix into the mold through the feeding hopper, the feeding hopper tapering downward as far as the discharge opening;

moving the feeding hopper along a path of motion deviating from the path of travel of the apparatus;

compacting the mix at a bottom end of the feeding hopper; and controlling the path of motion of the feeding hopper such that a vertical component of a path of motion of a bottom part of the feeding hopper exceeds a vertical component of a path of motion of a top part of the feeding hopper the vertical component of the path of motion of the top part of the feeding hopper being >0 or =0.

2. A method as defined in claim 1, wherein the path of motion of the bottom part of the feeding hopper includes a horizontal component.

3. A method as defined in claim 2, wherein the path of motion of the top part of the feeding hopper includes a horizontal component that exceeds the horizontal component of the path of motion of the bottom part of the feeding hopper.

4. A method as defined in claim 1, comprising the further steps of guiding the mix with the feeding hopper and compacting the mix near to a final density of the mix with the feeding hopper.

5. A method as defined in claim 4, wherein the mold includes side walls and a top plate, and movement of the feeding hopper causes a change in direction of flow of the mix between the feeding hopper and the top plate.

6. A slide casting apparatus for casting concrete products comprising:

a mold having a base, the base including side walls and a top plate;

a frame, the frame being movable relative to the base along a path of travel:

a driving mechanism for moving the frame in the path of travel:

a feeding hopper mounted on the frame and disposed above the the mold, feeding hopper tapering downward as far as a discharge opening of the feeding hopper for feeding concrete mix into the mold, the feeding hopper including a driving mechanism for moving the feeding hopper along a path of motion deviating from the path of travel of the frame:

wherein the feeding hopper driving mechanism controls the path of motion of the feeding hopper such that a vertical component of the path of motion of a bottom part of the feeding hopper exceeds a vertical component of a path of motion of a top part of the feeding hopper, the path of motion of the top part of the feeding hopper being >0 or =0.

7. A slide casting apparatus as defined in claim 6, wherein the feeding hopper driving mechanism includes a first cam connected to the bottom part of the feeding hopper, a second cam connected to the top part of the feeding hopper, and an articulated cam connecting the first cam and the second cam, the first and second cams each being arranged to cause a vertical component of motion in the top part of the feeding hopper and such that the vertical component of motion caused in the top part of the feeding hopper by the first cam cancels the vertical component of movement caused in the top part of the feeding hopper by the second cam.

8. A slide casting apparatus as defined in claim 7, further comprising a vibrator which vibrates the feeding hopper.

9. A slide casting apparatus as defined in claim 6, wherein the feeding hopper includes a wall, so that an inner surface of the wall slopes downward towards a side of the feeding hopper that trails the feeding hopper in a direction of travel of the frame.

10. A slide casting apparatus as defined in claim 6, wherein the feeding hopper includes a wall having a bottom end, the wall leading the feeding hopper in a direction of travel of the frame and extending below the top plate of the mold.

11. A slide casting apparatus as defined in claim 6, wherein the feeding hopper includes an end wall that trails the feeding hopper in a direction of travel of the frame, is separate from a remaining portion of the feeding hopper, and is movable along a path of motion deviating from the path of motion of the feeding hopper.

12. A slide casting apparatus as defined in claim 6, wherein the feeding hopper includes a a concrete compacting zone that decreases in cross-section from a top to a bottom of the concrete compacting zone.

13. A method as defined in claim 2, comprising the further steps of guiding the mix with the feeding hopper and compacting the mix near to a final density of the mix with the feeding hopper.

14. A method as defined in claim 3, comprising the further steps of guiding the mix with the feeding hopper and compacting the mix near to a final density of the mix with the feeding hopper.

15. A slide casting apparatus as defined in claim 7, wherein the feeding hopper includes a wall, the wall being tilted so that an inner surface of the wall slopes downward towards a side of the feeding hopper that trails the feeding hopper in a direction of travel of the frame.

16. A slide casting apparatus as defined in claim 8, wherein the feeding hopper includes a wall, the wall being tilted so that an inner surface of the wall slopes downward towards a side of the feeding hopper that trails the feeding hopper in a direction of travel of the frame.

17. A slide casting apparatus as defined in claim 7, wherein the feeding hopper includes a wall having a bottom end, the wall leading the feeding hopper in a direction of travel of the frame and extending below the top plate of the mold.

18. A slide casting apparatus as defined in claim 8, wherein the feeding hopper includes a wall having a bottom end, the wall leading the feeding hopper in a direction of travel of the frame and extending below the top plate of the mold.

19. A slide casting apparatus as defined in claim 7, wherein the feeding hopper includes an end wall that trails the feeding hopper in a direction of travel of the frame, is separate from a remaining portion of the feeding hopper, and is movable along a path of motion deviating from the path of motion of the feeding hopper.

20. A slide casting apparatus as defined in claim 7, wherein the feeding hopper includes a a concrete compacting zone that decreases in cross-section from a top to a bottom of the concrete compacting zone.

21. A method as defined in claim 2, wherein the horizontal component of the path of motion of the bottom part of the feeding hopper is parallel to the direction of the path of travel of the apparatus.

22. A method as defined in claim 21, wherein the path of motion of the top of the feeding hopper includes a horizontal component that exceeds the horizontal component of the path of motion of the bottom part of the feeding hopper.

23. A method as defined in claim 21, comprising the further steps of guiding the mix with the feeding hopper and compacting the mix near to a final density of the mix with the feeding hopper.

24. A method as defined in claim 23, wherein the mold includes side walls and a top plate, and movement of the feeding hopper causes a change in direction of flow of the mix between the feeding hopper and the top plate.

* * * * *